US005362586A

United States Patent [19]

Foley

[11] Patent Number: 5,362,586

[45] Date of Patent: Nov. 8, 1994

[54] PROCESS FOR TWO COLOR IMAGING COMPRISING A PHOTORECEPTOR HAVING A UNIPOLAR HOLE TRANSPORTING LAYER

[75] Inventor: Geoffrey M. T. Foley, Fairport, N.Y.

[73] Assignee: Xerox Corporation, Stamford, Conn.

[21] Appl. No.: 904,292

[22] Filed: Jun. 25, 1992

Related U.S. Application Data

[63] Continuation of Ser. No. 634,588, Dec. 27, 1990, abandoned.

[51] Int. Cl.[5] ..... G03G 15/02

[52] U.S. Cl. ..... 430/58; 430/59

[58] Field of Search ..... 430/58, 45, 46, 59

[56] References Cited

U.S. PATENT DOCUMENTS

| | | | |
|---|---|---|---|
| 3,043,686 | 7/1962 | Bickmore | 96/1 |
| 3,687,661 | 8/1972 | Sato et al. | 44/95 |
| 3,807,998 | 4/1974 | Kinoshita et al. | 96/1.2 |
| 3,918,970 | 11/1975 | Anzai | 96/1.2 |
| 3,970,383 | 7/1976 | Honda et al. | 355/4 |
| 3,977,777 | 8/1976 | Tanaka et al. | 355/1 |
| 4,045,219 | 8/1977 | Bean | 96/1.2 |
| 4,095,888 | 6/1978 | Kawazu et al. | 355/4 |
| 4,250,239 | 2/1981 | Sakai | 430/42 |
| 4,281,051 | 7/1981 | Sakai | 430/42 |
| 4,310,610 | 1/1982 | Sakai | 430/42 |
| 4,335,194 | 6/1982 | Sakai | 430/42 |
| 4,370,398 | 1/1983 | Sato | 430/42 |
| 4,378,415 | 3/1983 | Chu | 430/58 |
| 4,384,033 | 5/1983 | Sakai | 430/42 |
| 4,410,616 | 10/1983 | Griffiths et al. | 430/59 |
| 4,518,987 | 5/1985 | Saitoh et al. | 358/75 |
| 4,518,988 | 5/1985 | Saitoh et al. | 358/75 |
| 4,555,463 | 11/1985 | Hor et al. | 430/59 |
| 4,661,428 | 4/1987 | Ishida | 430/58 |

FOREIGN PATENT DOCUMENTS

| | | |
|---|---|---|
| 0077217 | 4/1983 | European Pat. Off. . |
| 0007339 | 1/1979 | Japan . |
| 0155047 | 12/1979 | Japan . |
| 0029845 | 3/1980 | Japan . |
| 0043548 | 3/1980 | Japan . |
| 0089846 | 7/1980 | Japan . |
| 0089848 | 7/1980 | Japan . |
| 0110260 | 8/1980 | Japan . |
| 0035152 | 4/1981 | Japan . |
| 0065140 | 6/1981 | Japan . |
| 0121046 | 9/1981 | Japan . |
| 0132158 | 8/1982 | Japan . |
| 1484927 | 9/1977 | United Kingdom . |
| 1563001 | 3/1980 | United Kingdom . |
| 1563007 | 3/1980 | United Kingdom . |
| 2028535 | 3/1980 | United Kingdom . |
| 1586101 | 3/1981 | United Kingdom . |

*Primary Examiner*—Steve Rosasco
*Attorney, Agent, or Firm*—Kenyon & Kenyon

[57] ABSTRACT

A photoreceptor for use in a two color electrostatic imaging process is disclosed which comprises a conductive substrate layer; a first photogenerating layer overlaying the substrate layer which is sensitive to a first wavelength; a unipolar hole transporting layer overlaying the first photogenerating layer; and a second photogenerating layer overlaying the hole transporting layer which is sensitive to a second wavelength and at least partially transmits the first wavelength; wherein the transporting layer is substantially transparent to the first wavelength.

An apparatus for forming multi-color images of an object employing the photoreceptor of the invention, wherein the color images are properly registered with respect to each other, is also disclosed.

26 Claims, 2 Drawing Sheets

PROCESS FOR TWO COLOR IMAGING COMPRISING A PHOTORECEPTOR HAVING A UNIPOLAR HOLE TRANSPORTING LAYER

This is a continuation of application Ser. No. 634,588 filed Dec. 27, 1990 abandoned.

FIELD OF THE INVENTION

The present invention relates to photoreceptors useful for generation of multi-color images and to processes and apparatuses for producing properly-registered multi-color images.

BACKGROUND OF THE INVENTION

Numerous photoreceptor devices for electrostatographic imaging systems are known including devices incorporating selenium, selenium alloys; layered inorganic photoreceptor devices; and layered organic photoreceptor devices. Examples of layered organic devices include those containing a charge transporting layer and a charge generating layer. Thus, for example, an illustrative layered organic device can be comprised of a conductive substrate, overcoated with a charge generating layer, which is in turn overcoated with a transporting layer. In a further variation of this device, the transporting layer can be overcoated with the generating layer. U.S. Pat. No. 4,410,616 discloses another variation in which a transport layer is sandwiched between two generating layers. Additional similar layers can also be added to achieve different charging characteristics.

Many systems employing configurations of these types of layers have been proposed for forming multicolor electrostatic images. Representative patents disclosing such systems include U.S. Pat. Nos. 4,378,415; 4,335,194; 4,281,051; 4,250,239 and 4,310,610. However, most of these systems use photoreceptors incorporating a trapping layer between the two photogenerating layers and/or an ambipolar transport layer in the photoreceptor architecture. These characteristics make fabrication of the photoreceptors complicated and fairly expensive. Moreover, many prior multi-color systems require complicated means for assuring that successive images are properly registered or require development cycles between charge/exposure cycles. It would, therefore, be desirable to provide a photoreceptor with an architecture which provides for multi-color image processing without the incorporation of unnecessary or expensive layers. It would also be desirable to provide such a system which simply and efficiently provides for proper registration of electrostatic images during the charge/exposure cycles.

SUMMARY OF THE INVENTION

In accordance with the present invention, a photoreceptor for use in a two color electrostatic imaging process is disclosed. The photoreceptor of the present invention comprises a conductive substrate layer; a first photogenerating layer overlaying the substrate layer which is sensitive to a first wavelength; a unipolar hole transporting layer overlaying the first photogenerating layer; and a second photogenerating layer overlaying the hole transporting layer which is sensitive to a second wavelength and at least partially transmits the first wavelength; wherein the transporting layer is substantially transparent to the first wavelength. With a proper choice for the sensitivity of the photogenerating layers, two-color copies can be made from an original with areas of black and one other color.

In certain preferred embodiments, the photogenerating layers are chosen for reproduction from a red and black original. In such preferred embodiments either (1) the first wavelength is in the blue region of the spectrum and the second wavelength is in the red region of the spectrum, or (2) the first wavelength is in the red region of the spectrum and the second wavelength is in the blue region of the spectrum. Most preferably the blue wavelength is from about 425 to about 480 nanometers and the red wavelength is from about 600 to about 675.

An electrostatic imaging process for duplication of an original having discrete areas of black and red is also disclosed. The process comprises forming an electrostatic image on a photoreceptor (first wavelength: blue; second wavelength: red); and developing the electrostatic image with oppositely charged black and red toner particles. Depending upon the charge and exposure cycles to which the photoreceptor is exposed, the red and black toner particles stick to oppositely charged portions of the electrostatic image producing the desired pattern of black and red.

A black and red copy can be made according to this process from a black and red original by a process of the present invention which employs a photoreceptor as disclosed herein wherein the electrostatic image is formed by positively charging the photoreceptor at a surface charge density of $2\sigma$; exposing the photoreceptor with red-filtered white light; negatively charging the photoreceptor with a constant current charge at a surface charge density of $-\sigma$; and exposing the photoreceptor with unfiltered white light; wherein the black and red toner particles are negatively and positively charged, respectively. In the event that the second photogenerating layer is partially red transmitting, it is desirable that the second exposure step employs blue filtered light in preference to white light.

A copy displaying only the black portions of a black and red original can be made by a process of the present invention which employs a photoreceptor as disclosed herein wherein the electrostatic image is formed by positively charging the photoreceptor at a surface charge density of $\sigma$; and exposing the photoreceptor with red-filtered white light; wherein the black and red toner particles are negatively and positively charged, respectively.

A copy displaying only the red portions of a black and red original can be made by a process of the present invention which employs a photoreceptor as disclosed herein wherein the electrostatic image is formed by positively charging the photoreceptor at a surface charge density of $\sigma$; exposing the photoreceptor with red-filtered white light; negatively charging the photoreceptor with a constant current charge at a surface charge density of $-\sigma$; and exposing the photoreceptor with unfiltered white light; wherein the black and red toner particles are negatively and positively charged, respectively. In the event that the second photogenerating layer is partially red transmitting, it is desirable that the second exposure step employs blue filtered light in preference to white light.

A copy displaying both the red and black portions of a black and red original as black only can be made by a process of the present invention which employs a photoreceptor as disclosed herein wherein the electrostatic image is formed by positively charging the photoreceptor at a surface charge density of $\sigma$; and exposing the photoreceptor with green-filtered white light; wherein the black and red toner particles are negatively and positively charged, respectively.

A copy displaying both the red and black portions of a black and red original as red only can be made by a process of the present invention which employs a photoreceptor as disclosed herein wherein the electrostatic image is formed by negatively charging the photoreceptor at a surface charge density of $-\sigma$; and exposing the photoreceptor with unfiltered white light; wherein the black and red toner particles are positively and negatively charged, respectively. In the event that the second photogenerating layer is partially red transmitting, it is desirable that the exposure step employs blue filtered light in preference to white light.

The photoreceptor as previously described in which the first wavelength is in the blue region of the spectrum and the second wavelength is in the red region of the spectrum may also be utilized to provide corresponding reproduction of blue/black originals provided that the polarities of the previously described charging steps are each reversed and a blue filter is utilized wherever a red filter was previously prescribed. In addition, the black and blue toner particles are then positively and negatively charged, respectively.

The photoreceptors of the present invention can also be configured to permit reproduction of blue/black originals utilizing a first photogenerating layer which is red sensitive and a second photogenerating layer which is blue sensitive and red transmissive. With this configuration blue and black documents can be reproduced by means of the same charge and exposure processes previously described for red/black duplication, but utilizing a blue filter wherever a red filter was previously prescribed and a red filter wherever a blue filter was previously prescribed; wherein the black and blue toners are positively and negatively charged, respectively. This same photoreceptor configuration can also be used for duplication of red/black originals provided that the polarities of the charging steps are reversed and a red filter is utilized wherever a blue filter was prescribed and a red filter wherever a blue filter was prescribed.

An apparatus for forming multi-color images of an object, wherein the color images are properly registered with respect to each other, is also disclosed. The apparatus comprises a planar platen; a photoreceptor having an imaging surface, a portion of which is parallel to and spaced from the platen; and a charging unit movably positioned between the platen and the photoreceptor to provide for scanning-the object when placed on the platen, the charge unit having a front end and a back end. The charging unit comprises optical means to expose the photoreceptor to activating radiation by focusing an optical image of the object onto the imaging surface; removable activating radiation filtering means disposed to cooperate with the optical means; a first charging means to charge the photoreceptor to a first polarity producing a first electrostatic image on the imaging surface, the first charging means being positioned with respect to the optical means toward the front end of the charging unit; a second charging means to charge the photoreceptor to a second polarity opposite to the first polarity producing a second electrostatic image on the imaging surface, the second charging means being positioned with respect to the optical means toward the back end of the charging unit; an illuminating means to illuminate the object when it is placed on the platen positioned with respect to the optical means for proper formation of the optical image. In operation of the apparatus, the charge unit scans the object in the direction of the front end during production of the first electrostatic image and then scans the object in the direction of the back end to produce the second electrostatic image in proper registration with the first electrostatic image.

In certain embodiments the photoreceptor of the apparatus is a photoreceptor of the present invention, the first and second charging means are corotrons (corona discharge elements), the optical means is a selfoc lens, and the filtering means is a set of filters corresponding to different wavelengths.

The photoreceptors and apparatuses of the present invention provide significant advantages over prior multi-color single imaging systems by eliminating from the photoreceptor a trapping layer between the two photogenerating layers and by including a unipolar transport layer rather than an ambipolar layer. These characteristics make fabrication of the photoreceptors substantially easier and more economical when compared to prior systems.

DETAILED DESCRIPTION OF THE PREFERRED EMBODIMENTS

Figure 1:
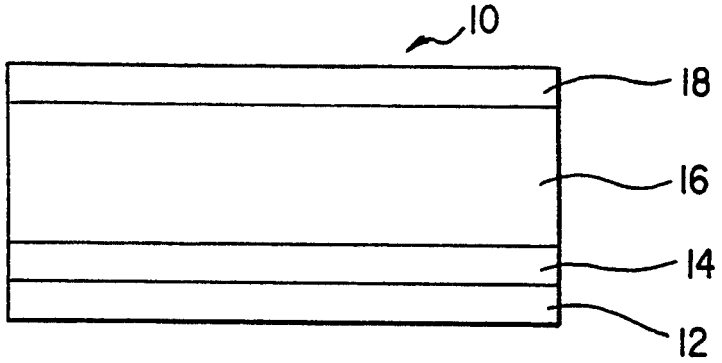
FIG. 1 is a schematic representation of the layers of a photoreceptor in accordance with the present invention.

Illustrated in FIG. 1 is the photoreceptor device of the present invention generally designated 10 comprising a substrate layer 12, a first photogenerating layer 14, a transporting layer 16 and a second photogenerating layer 18.

The substrate layer may be opaque, or substantially transparent, and may comprise various suitable materials possessing the required site mechanical properties. The substrate may thus be comprised of a layer of nonconducting material, such as an inorganic or organic polymeric material, having a conductive surface layer arranged thereon, such as aluminized Mylar (commercially available from Martin Processing, Inc.), or a conductive material such as, for example, aluminum, brass or the like. The substrate layer may be flexible or rigid and may have any of many different configurations such as, for example, a plate, a cylindrical drum, a scroll, an endless flexible belt, and the like.

The thickness of the substrate layer depends on many factors, including economic considerations, thus this layer may be of substantial thickness, for example, over 100 mils, or of minimum thickness providing the objectives of the present invention are achieved. In one preferred embodiment the substrate thickness ranges from about 3 to about 7 mils.

The first photogenerating layer can be comprised of numerous suitable materials, providing for example that these materials allow the injection of photoexcited charge carriers into the transport layer. Illustrative examples of such materials include amorphous selenium, selenium arsenic alloys, selenium tellurium alloys, halogen doped selenium compositions, halogen doped selenium alloys, phthalocyanines, such as the x-form of metal free phthalocyanines, metal phthalocyanines, such as zinc phthalocyanines, other phthalocyanines such as vanadyl phthalocyanine, squaraines, cadmium compounds of sulfur, selenium and tellurium, chlozadiane blue, thiapyrilium, and the like. These materials can be used alone or as a dispersion in a polymeric binder, including those disclosed in U.S. Pat. No. 3,121,006, the disclosure of which is wholly incorporated herein by reference. A preferred first photogenerating layer is comprised of trigonal selenium in PVK, wherein the percentage of selenium present ranges from about 3 to about 90 volume percent.

Generally the first photogenerating layer ranges in thickness of from about 0.05 microns to about 10 microns, and preferably from about 0.1 microns to about 3 microns, it being noted that the optimum thickness of this layer is dependent on a number of factors, including mechanical considerations, the nature and degree of photosensitivity desired, and the like.

The second photogenerating layer can be comprised of the same types of materials described herein for the first photogenerating layer or it may be comprised of different materials. A preferred photogenerating layer is comprised of a pigment of vanadyl phthalocyanine, dispersed in a resin binder, such as a polycarbonate resin, wherein the percentage of the phthalocyanine present ranges from about 12 volume percent to about 25 volume percent. The second photogenerating layer ranges in thickness from about 0.05 microns to about 2 microns, preferably from about 0.1 microns to about 1.0 microns; however, the exact thickness of the layer depends on a number of factors, including the degree of optical absorption.

The hole transporting layer or charge carrier transport layer can be comprised of a number of suitable materials which are transparent to light, and are capable of transporting holes. This layer has a thickness of from about 5 microns to about 50 microns, preferably from about 10 microns to about 30 microns. In certain embodiments, this layer is comprised of a highly insulating organic resin, such as those disclosed in U.S. Pat. No. 3,161,006, and preferably a polycarbonate resin, having dissolved therein small molecules of an electrically active material. In one preferred embodiment, the transport layer comprises molecules of the formula

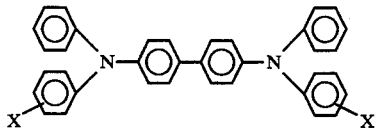

dispersed in a highly insulating and transparent organic resinous material, wherein X is selected from the group consisting of alkyl and halogen, and preferably ortho methyl, meta methyl, para methyl, ortho chloro, meta chloro or para chloro, reference U.S. Pat. Nos. 4,251,612 and 4,265,990 the disclosures of which are wholly incorporated herein by reference.

The transporting layer is substantially non-absorbing in the spectral region of intended use (i.e., visible light), but it allows the injection of photogenerated holes from the charge photogenerating layers and subsequent transport of holes across that layer. The highly insulating resin employed has a resistivity of at least $10^{12}$ ohm-cm, to prevent undue dark decay, and is a material which is not necessarily capable of supporting the injection of holes from the generating layers, and is not capable of allowing the transport of these holes through the material. However, the resin becomes electrically active and capable of transporting holes when it contains from about 10 to 75 weight percent of the substituted N,N,N',N'-tetraphenyl-[1,1'-biphenyl]-4,4' diamines corresponding to the foregoing formula. Substances corresponding to this formula include, for example, N,N'-diphenyl-N,N'-bis(alkylphenyl)-[1,1'-biphenyl]-4,4'-diamine, wherein the alkyl is selected from the group consisting of methyl (such as 2-methyl, 3-methyl and 4-methyl), ethyl, propyl, butyl, hexyl and the like. With chloro substitution, the substance is N,N'-diphenyl-N,N'-bis(halophenyl)-[1,1'-biphenyl]-4,4'-diamine, wherein the halo atom is 2-chloro, 3-chloro or 4-chloro.

Other electrically active small molecules which can be dispersed in the electrically inactive resin to form a layer which will transport holes include triphenylmethane, bis-(4-diethylamino)-2,2'-dimethyltriphenylmethane, bis-4-(diethylamino phenyl) phenylmethane, and 4,4'-bis(diethylamino)-2,2'-dimethyltriphenylmethane.

Generally from about 10 percent to about 75 percent by weight of the active diamine, and preferably from about 30 percent to about 50 percent by weight, are dispersed in the resinous binder.

In one preferred embodiment, the photoreceptor of the present invention is comprised of a transport layer, with a thickness of about 20 microns, consisting of N,N'-diphenyl-N',N'-bis(3-methylphenyl) -1,1'-diphenyl-4,4'-diamine dispersed in a polycarbonate binder.

The transport layer of the photoreceptor of the present invention is unipolar and capable of transporting only one sign of charge. This provides for a broader selection of possible materials and would be feasible if the two-color process described herein required an ambipolar transport layer capable of transporting both holes and electrons.

Figure 7:
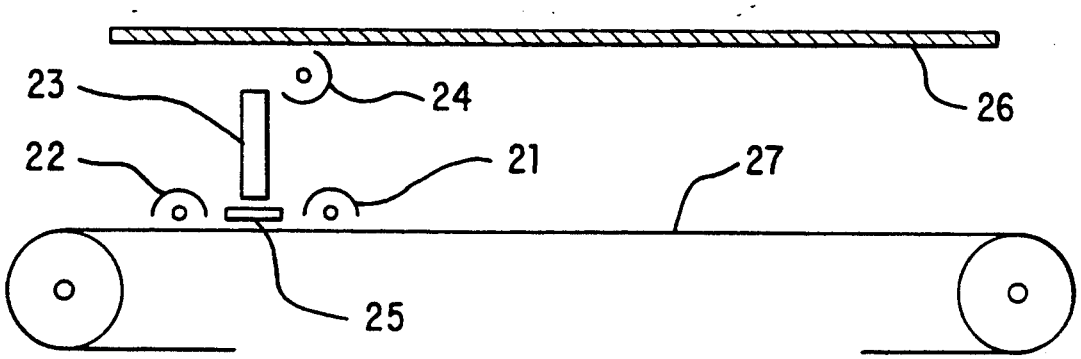
FIG. 7 is a schematic representation of an apparatus for forming multi-color images of an object in accordance with the present invention.

An apparatus for forming multi-color images of an object employing the photoreceptor of the invention, wherein the color images are properly registered with respect to each other, is schematically represented in FIG. 7. The apparatus comprises first corotron 21, second corotron 22, lens 23, illuminating element 24, filter 25, platen 26 and photoreceptor 27. First corotron 21, second corotron 22, lens 23, illuminating element 24, and filter 25 comprise the "charging unit" as that term is used herein. First corotron 21 is located at the front end (shown as the right end in FIG. 7) of the charging unit. Second corotron 22 is located at the back end (shown as the left end in FIG. 7) of the charging unit. Lens 23 is positioned between the first and second corotrons such that, depending on the direction the apparatus is scanning, the lens always follows behind the active corotron to expose the photoreceptor.

In operation, an original is placed on platen 26. The charging unit then first scans the original from left to right (as shown in FIG. 7) with the first corotron activated while the platen and photoreceptor remain stationery. A first electrostatic image is produced on the photoreceptor as a result of the scan. After the first scan is complete, the second corotron is activated and the charging unit scans in the opposite direction, thus producing a second electrostatic image in proper registration with the first image. The corotrons and lens are aligned such that the images produced thereby are in proper registration. The imaging surface of the photoreceptor can then be developed by known methods.

The following examples are illustrative of certain embodiments of the invention and are not intended to be limiting of the invention which is defined by the appended claims.

EXAMPLE 1

A photoreceptor of the present invention is made of successive layers coated on a 3 mil polyester base comprising in sequence:

i) An electrically conductive ground plane comprising 200 angstroms of titanium;
ii) A siloxane hole blocking layer 450 angstroms thick
iii) A polyester interface layer comprising 0.05 microns of DuPont 49000 resin;
iv) A first photogenerating layer comprising 1.8 microns of a 7.5 percent by volume dispersion of trigonal selenium in polyvinylcarbazole binder;
v) A hole transport layer comprising 24 microns of a 40 percent by weight loading of N,N'-diphenyl-N,N'-bis(3-methylphenyl)-[1,1'-biphenyl]-4,4'-diamine in Makrolon, a polycarbonate resin having a molecular weight from about 50,000 to about 100,000 and available from Farbenfabriken Bayer A.G.;
vi) A second photogenerating layer comprising 1.0 microns of 18 volume percent of vanadyl phthalocyanine dispersed in a resin binder.

An anticurl backcoating is also applied.

EXAMPLE 2

Figure 2:
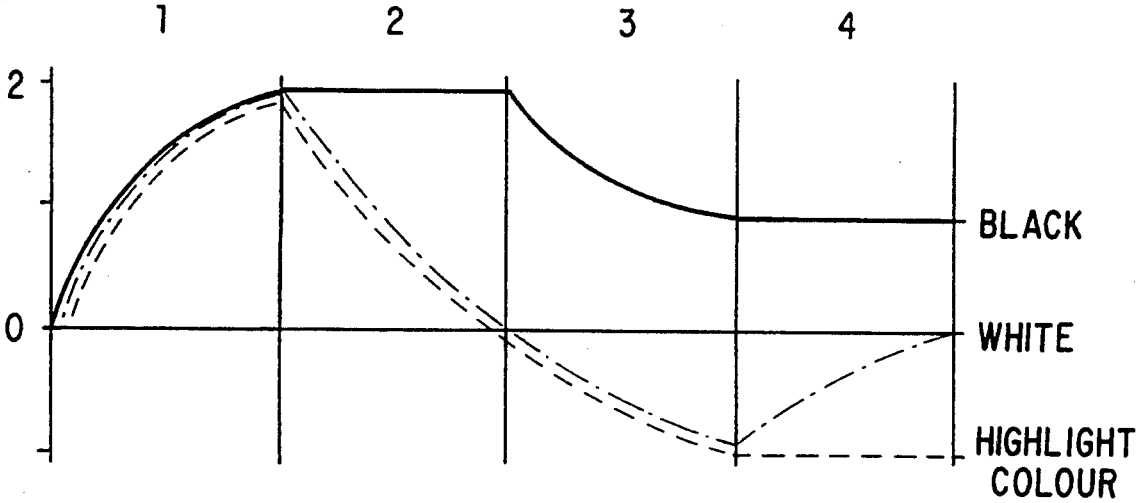
FIGS. 2–6 are graphs of the variation in relative charge polarity of black, white and highlight color areas of the electrostatic image formed in accordance with Examples 2–6, respectively. The "Phases" of the image formation process as described in the examples are numbered accordingly in FIGS. 2–6.

A black and red copy is made from a black and red original by a process of the present invention using an apparatus of the present invention. A photoreceptor made according to Example 1 is charged and exposed as follows. The relative effective surface charge of various areas of the electrostatic image during the process is shown in FIG. 2.

The black and red original is placed on the platen. The original is illuminated and the charging unit begins to scan the original. As the unit scans by moving in the direction of the front end of the unit, the first corotron positively charges the photoreceptor at a surface charge density of $2\sigma$ such that all areas of the imaging surface are evenly charged (Phase 1). The lens moves along behind the first corotron and exposes the photoreceptor with red-filtered white light, dissipating charge in areas corresponding to white and red areas of the original (Phase 2). After completion of the first scan, the charging unit reverses direction and scans the original in the opposite direction. As the unit scans for the second time, the second corotron negatively charges the photoreceptor with a constant current charge at a surface charge density of $-\sigma$, resulting in an effective surface charge density of $\sigma$ in image areas corresponding to black areas of the original and of $-\sigma$ in white and red areas (Phase 3). The lens moves along behind the second corotron and exposes the photoreceptor with unfiltered white light, dissipating the effective surface charge in white areas (Phase 4).

After completion of this charge/exposure cycle black areas of the electrostatic image have a charge density of $\sigma$, white areas are uncharged, and red areas have a charge density of $-\sigma$. The resultant electrostatic image is developed with negatively charged black toner and positively charged red toner, resulting in a black and red developed image duplicative of the original.

EXAMPLE 3

Figure 3:
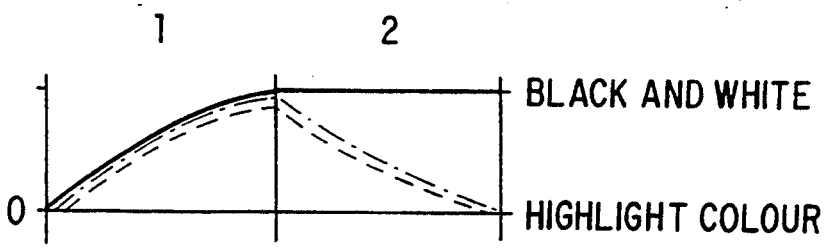

A copy of a black and red original displaying only the black portions of the original is made by a process of the present invention using an apparatus of the present invention. A photoreceptor made according to Example 1 is charged and exposed as follows. The relative effective surface charge of various areas of the electrostatic image during the process is shown in FIG. 3.

The black and red original is placed on the platen. The original is illuminated and the charging unit begins to scan the original. As the unit scans, the first corotron positively charges the photoreceptor at a surface charge density of $\sigma$ such that all areas of the imaging surface are evenly charged (Phase 1). The lens moves along behind the first corotron and exposes the photoreceptor with red-filtered white light, dissipating charge in areas corresponding to the white and red areas of the original (Phase 2).

After completion of this charge/exposure cycle black areas of the electrostatic image have a charge density of $\sigma$ and white and red areas are uncharged. The resultant electrostatic image is developed with negatively charged black toner, resulting in a black developed image duplicative of the black portions of the original.

EXAMPLE 4

Figure 4:
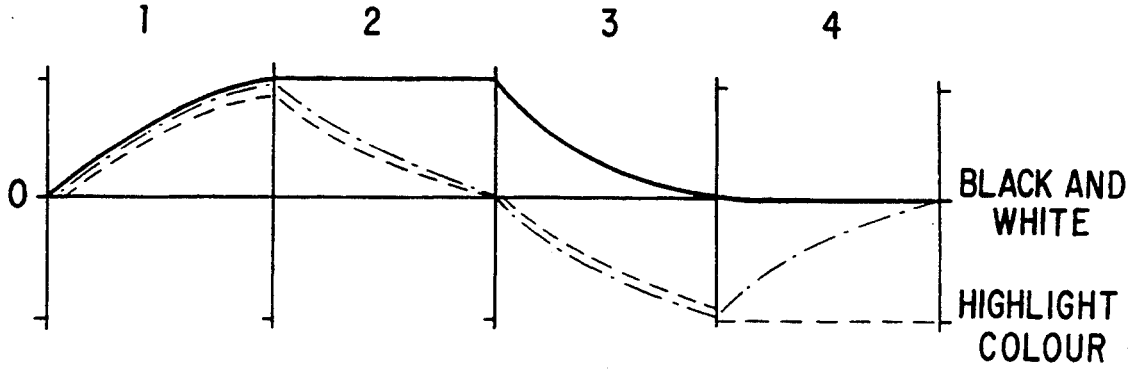

A copy of a black and red original displaying only the red portions of the original is made by a process of the present invention using an apparatus of the present invention. A photoreceptor made according to Example 1 is charged and exposed as described in Example 2, except that the initial charge density provided by the first corotron is only $\sigma$. The relative effective surface charge of various areas of the electrostatic image during the process is shown in FIG. 4.

After completion of this charge/exposure cycle red areas of the electrostatic image have a charge density of $-\sigma$ and black and white areas are uncharged. The resultant electrostatic image is developed with positively charged red toner, resulting in a red developed image duplicative of the red portions of the original.

EXAMPLE 5

Figure 5:
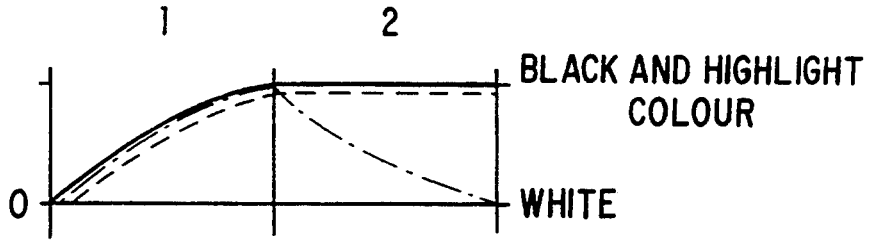

A copy of a black and red original displaying both the black and red portions of the original as black is made by a process of the present invention using an apparatus of the present invention by taking advantage of the green sensitivity of the top photogenerating layer. A photoreceptor is made according to Example 1. The photoreceptor is charged and exposed as described in Example 3, except that green filtered white light is substituted for red filtered white light. The relative effective surface charge of various areas of the electrostatic image during the process is shown in FIG. 5.

After completion of this charge/exposure cycle black and red areas of the electrostatic image have a charge density of $\sigma$ and white areas are uncharged. The resultant electrostatic image is developed with negatively charged black toner, resulting in a black developed image duplicative of the black and red portions of the original.

EXAMPLE 6

Figure 6:
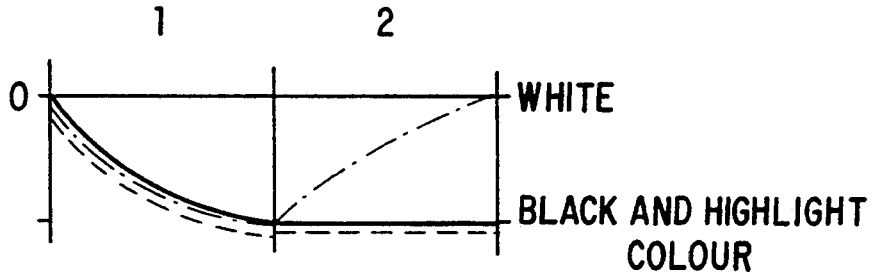

A copy of a black and red original displaying both the black and red portions of the original as red is made by a process of the present invention using an apparatus of the present invention. A photoreceptor is made according to Example 1 and charged and exposed as follows. The relative effective surface charge of various areas of the electrostatic image during the process is shown in FIG. 6.

The black and red original is placed on the platen. The original is illuminated and the charging unit begins to scan the original. As the unit scans, the first negatively charges the photoreceptor at a surface charge density of $-\sigma$, such that all areas of the imaging surface are evenly charged (Phase 1). The photoreceptor is exposed with unfiltered white light, dissipating charge in white areas (Phase 2).

After completion of this charge/exposure cycle black and red areas of the electrostatic image have a charge density of $-\sigma$ and white areas are uncharged. The resultant electrostatic image is developed with positively charged red toner, resulting in a red developed image duplicative of both the black and red portions of the original.

What is claimed is:

1. An electrostatic imaging process for duplication of an original having discrete areas of black and a second highlight color selected from the group consisting of red and blue, said process comprising:

(a) forming an electrostatic image on a photoreceptor, said photoreceptor comprising:
  (1) a conductive substrate layer;
  (2) a first photogenerating layer overlaying said substrate layer which is sensitive to a first wavelength;
  (3) a unipolar hole transporting layer overlaying said first photogenerating layer; and
  (4) a second photogenerating layer overlaying said hole transporting layer which is sensitive to a second wavelength and at least partially transmits said first wavelength;

wherein said transporting layer is substantially transparent to said first wavelength, and wherein said electrostatic image is formed by at least one constant current charge/exposure cycle; and (b) developing said electrostatic image with toner particles of black and said second color which are oppositely charged.

2. The process of claim 1 wherein said first wavelength is in the blue region of the spectrum and said second wavelength is in the red region of the spectrum.

3. The process of claim 2 wherein said first wavelength is from about 425 to about 480 nanometers and said second wavelength is from about 600 to about 675 nanometers.

4. The process of claim 2 wherein said second color is red and wherein said electrostatic image is formed by a method comprising:

(1) positively charging said photoreceptor at a surface charge density of $2\sigma$;
(2) exposing said photoreceptor with red-filtered white light;
(3) negatively charging said photoreceptor with a constant current charge at a surface charge density of $-\sigma$; and
(4) exposing said photoreceptor with unfiltered or blue-filtered white light;

wherein said black and red toner particles are negatively and positively charged, respectively.

5. The process of claim 2 wherein said second color is red and wherein said electrostatic image is formed by a method comprising:

(1) positively charging said photoreceptor at a surface charge density of $\sigma$;
(2) exposing said photoreceptor with red-filtered white light;
(3) negatively charging said photoreceptor with a constant current charge at a surface charge density of $-\sigma$; and
(4) exposing said photoreceptor with unfiltered or blue-filtered white light;

wherein said black and red toner particles are negatively and positively charged, respectively.

6. The process of claim 5 wherein said second color is red and wherein said electrostatic image is formed by a method comprising:

(1) positively charging said photoreceptor at a surface charge density of $\sigma$; and
(2) exposing said photoreceptor with red-filtered white light;

wherein said black and red toner particles are negatively and positively charged, respectively.

7. The process of claim 5 wherein said second color is red and wherein said electrostatic image is formed by a method comprising:

(1) positively charging said photoreceptor at a surface charge density of $\sigma$; and
(2) exposing said photoreceptor with green-filtered white light;

wherein said second photogenerating layer is also green sensitive and wherein said black and red toner particles are negatively and positively charged, respectively.

8. The process of claim 2 wherein said second color is blue and wherein said electrostatic image is formed by a method comprising:

(1) negatively charging said photoreceptor at a surface charge density of $-2\sigma$;
(2) exposing said photoreceptor with blue-filtered white light;
(3) positively charging said photoreceptor with a constant current charge at a surface charge density of $\sigma$; and
(4) exposing said photoreceptor with unfiltered or red-filtered white light;

wherein said black and blue toner particles are positively and negatively charged, respectively.

9. The process of claim 2 wherein said second color is blue and wherein said electrostatic image is formed by a method comprising:

(1) negatively charging said photoreceptor at a surface charge density of $-\sigma$;
(2) exposing said photoreceptor with blue-filtered white light;
(3) positively charging said photoreceptor with a constant current charge at a surface charge density of $\sigma$; and
(4) exposing said photoreceptor with unfiltered or red-filtered white light;

wherein said black and blue toner particles are positively and negatively charged, respectively.

10. The process of claim 1 wherein said first wavelength is in the red region of the spectrum and said second wavelength is in the blue region of the spectrum.

11. The process of claim 10 wherein said first wavelength is from about 600 to about 675 nanometers and said second wavelength is from about 425 to about 480 nanometers.

12. The process of claim 10 wherein said second color is red and wherein said electrostatic image is formed by a method comprising:

(1) negatively charging said photoreceptor at a surface charge density of $-2\sigma$;

(2) exposing said photoreceptor with red-filtered white light;

(3) positively charging said photoreceptor with a constant current charge at a surface charge density of $\sigma$; and (4) exposing said photoreceptor with unfiltered or blue-filtered white light;

wherein said black and red toner particles are positively and negatively charged, respectively.

13. The process of claim 10 wherein said second color is red and wherein said electrostatic image is formed by a method comprising:

(1) negatively charging said photoreceptor at a surface charge density of $-\sigma$;

(2) exposing said photoreceptor with red-filtered white light;

(3) positively charging said photoreceptor with a constant current charge at a surface charge density of $\sigma$; and (4) exposing said photoreceptor with unfiltered or blue-filtered white light;

wherein said black and red toner particles are positively and negatively charged, respectively.

14. The process of claim 10 wherein said second color is blue and wherein said electrostatic image is formed by a method comprising:

(1) positively charging said photoreceptor at a surface charge density of $2\sigma$;

(2) exposing said photoreceptor with blue-filtered white light;

(3) negatively charging said photoreceptor with a constant current charge at a surface charge density of $-\sigma$; and (4) exposing said photoreceptor with unfiltered or red-filtered white light;

wherein said black and blue toner particles are positively and negatively charged, respectively.

15. The process of claim 10 wherein said second color is blue and wherein said electrostatic image is formed by a method comprising:

(1) positively charging said photoreceptor at a surface charge density of $\sigma$;

(2) exposing said photoreceptor with blue-filtered white light;

(3) negatively charging said photoreceptor with a constant current charge at a surface charge density of $-\sigma$; and (4) exposing said photoreceptor with unfiltered or red-filtered white light;

wherein said black and blue toner particles are positively and negatively charged, respectively.

16. The process of claim 1 wherein said electrostatic image is formed by two successive constant current charge/exposure cycles, and wherein the charge applied in the second of said cycles is opposite to that employed in the first of said cycles.

17. The process of claim 16 wherein said first wavelength is in the blue region of the spectrum and said second wavelength is in the red region of the spectrum.

18. The process of claim 17 wherein said second color is blue and wherein said electrostatic image is formed by a method comprising:

(1) negatively charging said photoreceptor at a surface charge density of $-\sigma$; and (2) exposing said photoreceptor with blue-filtered white light;

wherein said black and blue toner particles are positively and negatively charged, respectively.

19. The process of claim 17 wherein said second color is blue and wherein said electrostatic image is formed by a method comprising:

(1) negatively charging said photoreceptor at a surface charge density of $-\sigma$; and (2) exposing said photoreceptor with green-filtered white light;

wherein said second photogenerating layer is also green sensitive and wherein said black and blue toner particles are positively and negatively charged, respectively.

20. The process of claim 17 wherein said first wavelength is from about 425 to about 480 nanometers and said second wavelength is from about 600 to 675 nanometers.

21. The process of claim 16 wherein said first wavelength is in the red region of the spectrum and said second wavelength is in the blue region of the spectrum.

22. The process of claim 21 wherein said second color is red and wherein said electrostatic image is formed by a method comprising:

(1) negatively charging said photoreceptor at a surface charge density of $-\sigma$; and (2) exposing said photoreceptor with red-filtered white light;

wherein said black and red toner particles are positively and negatively charged, respectively.

23. The process of claim 21 wherein said second color is red and wherein said electrostatic image is formed by a method comprising:

(1) negatively charging said photoreceptor at a surface charge density of $-\sigma$; and (2) exposing said photoreceptor with green-filtered white light;

wherein said first photogenerating layer is green sensitive and wherein said black and red toner particles are positively and negatively charged, respectively.

24. The process of claim 21 wherein said second color is blue and wherein said electrostatic image is formed by a method comprising:

(1) positively charging said photoreceptor at a surface charge density of $\sigma$; and (2) exposing said photoreceptor with blue-filtered white light;

wherein said black and blue toner particles are positively and negatively charged, respectively.

25. The process of claim 21 wherein said second color is blue and wherein said electrostatic image is formed by a method comprising:

(1) positively charging said photoreceptor at a surface charge density of $\sigma$; and (2) exposing said photoreceptor with green-filtered white light;

wherein said first photogenerating layer is green sensitive and wherein said black and blue toner particles are positively and negatively charged, respectively.

26. The process of claim 21 wherein said first wavelength is from about 600 to about 675 nanometers and said second wavelength is from about 425 to about 480 nanometers.

* * * * *

UNITED STATES PATENT AND TRADEMARK OFFICE

CERTIFICATE OF CORRECTION

PATENT NO. : 5,362,586

DATED : November 8, 1994

INVENTOR(S) : Geoffrey M.T. Foley

It is certified that error appears in the above-indentified patent and that said Letters Patent is hereby corrected as shown below:

| Column | Line | |
|---|---|---|
| 3 | 50 | Change "scanning-the" to --scanning the-- |
| 10 | 15 | Change "claim 5" to --claim 17--. |
| 10 | 24 | Change "claim 5" to --claim 17--. |

Signed and Sealed this

Twenty-first Day of March, 1995

*Attest:*

Bruce Lehman

BRUCE LEHMAN

*Attesting Officer*

*Commissioner of Patents and Trademarks*